United States Patent [19]

Mease et al.

[11] Patent Number: 4,526,457

[45] Date of Patent: Jul. 2, 1985

[54] BOUYANT HANGER UNIT FOR DENTAL FILM CHIP

[75] Inventors: Richard B. Mease, Carpinteria; Robert E. Burridge, Santa Barbara, both of Calif.

[73] Assignee: M&D International Enterprises, Inc., Carpinteria, Calif.

[21] Appl. No.: 527,232

[22] Filed: Aug. 29, 1983

[51] Int. Cl.[3] ..... G03D 13/10

[52] U.S. Cl. ..... 354/345; 24/341; 24/485; 24/556

[58] Field of Search ..... 354/340, 343, 344, 345, 354/346, 347; 24/341, 461, 469, 470, 485, 531, 545, 546, 556, 562, 297; 40/158 B

[56] References Cited

U.S. PATENT DOCUMENTS

| | | | |
|---|---|---|---|
| 1,336,156 | 4/1920 | Preston | 24/341 |
| 2,854,910 | 10/1958 | Padgett | 354/345 |
| 3,013,654 | 12/1961 | Hoff | 24/562 |
| 3,807,002 | 4/1974 | Green | 354/345 |
| 4,192,602 | 3/1980 | Lamoreaux | 354/340 |

FOREIGN PATENT DOCUMENTS

| | | | |
|---|---|---|---|
| 340086 | 6/1904 | France | 354/345 |
| 450537 | 3/1913 | France | 354/345 |
| 1341140 | 9/1963 | France | 24/341 |

*Primary Examiner*—A. A. Mathews

*Attorney, Agent, or Firm*—John T. Matlago

[57] ABSTRACT

A bouyant hanger unit comprises an elongated body molded of plastic to provide a clip on the bottom end thereof for holding a dental film chip in the plane of the hanger unit. The hanger unit has a circular projection on one face thereof axially aligned with a circular recess on the opposite face thereof. Such a construction enables a plurality of hanger units to be assembled face-to-face while permitting any of the hanger units to be pivoted away from the remaining hanger units in the assembly for the purpose of examining the dental film chip clipped on the bottom thereof. When the individual hanger units or an assembly of the hanger units with dental film chips clipped on the bottom thereof are placed in a solution they float in an upright position with the upper end thereof extending above the surface of the solution.

6 Claims, 13 Drawing Figures

BOUYANT HANGER UNIT FOR DENTAL FILM CHIP

BACKGROUND OF THE INVENTION

This invention relates to dental film chip hangers and more particularly to a bouyant hanger unit for a dental film chip.

In order to reduce the cost of the equipment needed by a dentist to develop dental film chips that he has used to X-ray the mouth of a patient, the present practice is to provide a long metal hanger provided with transversely extending clips spaced along either side of the length thereof. Each clip is capable of holding a dental film chip. The metal hanger is hung by its hooked upper end above a tank of solution with the film chips immersed therein and is then manually transferred by its hooked upper end to successive tanks of solutions as needed to process the film chips.

Such a hanger unit because of its length is not only cumbersome to handle but requires deep tanks of solutions in which to immerse the dental film chips. Moreover, because of the depth of the solution required in the developer tank, the concentration of the chemicals making up the solution tends to vary at the different levels thereof with the result that the film chips held on the lower end portion of the hanger may develop differently than those held on the upper end thereof.

SUMMARY OF THE INVENTION

In accordance with the present invention a hanger unit for a dental film chip is molded of plastic to comprise a long, relatively thin rectangular body with a clip on the bottom end thereof. The body has a circular projection with a smaller diameter base molded on the front face thereof just below the upper end portion thereof and a circular recess with an enlarged diameter bottom molded on the back face thereof. The centers of the circular projection and the circular recess lie on the same axis. The body further has a circular hole through the central portion thereof which is provided with a circular projecting rim on the front face thereof and a circular peripheral recess on the back face thereof. The back face of the body is molded with the upper end portion thereof including the upper wall portion of the circular recess removed, leaving inwardly chamfered shoulders on either side of the circular recess. The remaining thin wall on the upper portion of the front face of the body forms the handle for the hanger unit. A longitudinal slot extends down through the middle of the upper half of the body including the handle portion, the circular projection, and on down to the circular hole.

To assemble a pair of hanger units, the circular projection on the front face of a first hanger unit is positioned against the chamfered shoulders on either side of the circular recess on the back face of a second hanger unit. Then, upon moving the hanger units longitudinally toward each other, the sides of the enlarged diameter bottom of the circular recess on the second hanger unit snap over the sides of the circular projection on the first hanger unit. When so positioned, the circular peripheral recess on the central portion of the back face of the second hanger unit is able to seat against the projecting circular rim on the central portion of the front face of the first hanger unit such that the two hanger units are assembled face-to-face.

Such a construction enables any number of hanger units with film chips on the bottom clips thereof to be assembled together face-to face and, when the assembly is placed in a solution, it floats in an upright position with the handle portions on the upper ends thereof extending above the surface of the solution. Note that any of the hanger units in the assembly can have its central circular peripheral rim and circular peripheral recess on the opposite faces thereof freed of the hanger units on either side thereof such that it can be pivoted on its upper circular projection and circular recess away from the remaining hanger units in the assembly for the purpose of enabling the dental film chip held by the clip on the bottom end thereof to be examined.

Accordingly, one of the objects of the present invention is to provide a low-cost plastic hanger unit having a clip on the bottom end thereof for use in bouyantly suspending a dental film chip in a processing solution with the upper end portion of the hanger unit extending above the surface of the solution.

Another object of the present invention is to provide a bouyant hanger unit having a clip on the bottom end thereof for holding a dental film chip wherein the hanger unit is adapted to be readily joined face-to-face with other similar hanger units to provide a multiple dental film chip hanger assembly that will float in a processing solution.

Still another object of the present invention is to provide a plastic hanger unit having a clip on the bottom end thereof for holding a dental film chip wherein the hanger unit is adapted to be readily joined face-to-face by means of a pivotal connection with other similar hanger units to provide an assembly and wherein any one of the hanger units can be pivotally swung on its connection away from the remaining hanger units in the assembly to enable the dental film chip on the bottom end thereof to be examined.

With these and other objects in view the invention consists of the construction, arrangement and combination of the various parts of the device whereby the objects contemplated are obtained, as hereinafter set forth, pointed out in the appended claims and illustrated in the accompanying drawings.

DESCRIPTION OF THE PREFERRED EMBODIMENT

Figure 1:
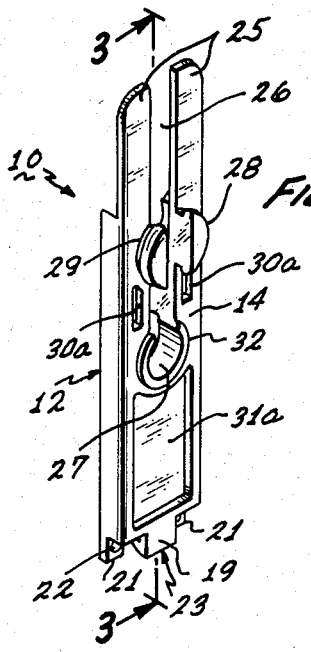
FIG. 1 is an elevational perspective view showing the front face of the dental film chip hanger unit in accordance with the present invention.
Figure 2:
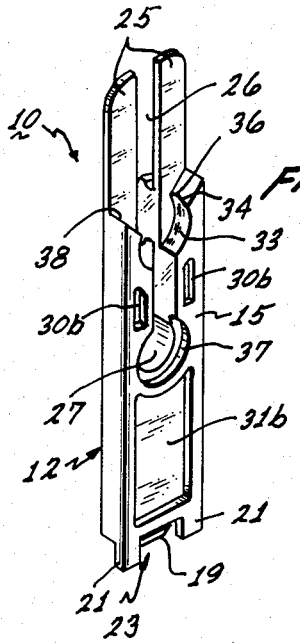
FIG. 2 is an elevational perspective view showing the back face of the hanger unit in FIG. 1.

Reference will first be made to FIGS. 1 and 2 showing a perspective view of a hanger unit 10 in accordance with the present invention. The hanger unit 10 is molded of plastic to include an elongated generally rectangular body 12 having a front face 14 and a back face 15. A clip 23 is provided on the bottom of the body 12. The clip 23 includes a thin tab 19 depending from the center of the front face 14 thereof and a thin tab 21 extending from each side of the back face 15 thereof. The internal surface of the center tab 19 is provided with an angular transverse stop 17 (FIG. 3) having a narrow end surface 18 and the internal surface of each of the spaced side tabs 21 is provided with a small protuberance 22. The small protuberances 22 on side tabs 21 and the opposing narrow end surface 18 on the central tab 19 may lie in slightly overlapping planes.

Molded on the front face 14 of the body 12 just below the upper portion thereof is a circular projection 28 provided with a smaller diameter circular base 29 and molded on the upper portion of the back face 15 so as to lie on the same axis with circular projection 28 is a circular recess 33 provided with an enlarged diameter bottom 36. The circular projection 28 on the front face 14 has the same outer diameter and cross section as the enlarged diameter bottom 36 of the circular recess 33 on the back face 15 of the body 12. The circular recess 33 is formed with an internal wall 34 which slants radially outwardly from the mouth to the enlarged diameter bottom 36 of the circular recess 33 and has a depth equal to the height of the circular projection 28.

The body 12 is molded with the upper end portion of its back face 15 and including the upper wall portion of the circular recess 33 thereon removed, leaving inwardly chamfered shoulders 38 on either side of the circular recess 33. The thin wall left on the upper end portion of the front face 14 of the body 12 forms a handle portion 25. The body 12 further has a circular hole 27 through the central portion thereof with a circular projecting rim 32 molded thereabout on the front face 14 thereof and with a circular peripheral recess 37 molded thereabout on the back face 15 thereof.

The peripheral circular recess 37 has the same outer diameter and cross section as the projecting circular rim 32 on the opposite face thereof. A longitudinal slot 26 extends down through the middle of the upper half of the body 12 including the handle portion 25, the circular projection 28, and on down to the circular hole 27.

As shown, the front face 14 of body 12 may be molded with a grooved recess 31*a* on either side of the longitudinal slot 26 intermediate the circular projection 28 and the circular hole 27 and may be molded with a generally rectangular recess 31*a* extending from just below the circular hole 27 to the bottom of the body 12. Likewise, the back face 15 may be molded with a grooved recess 30*b* on either side of the elongated slot 26 opposite the grooved recesses 30*a* on the front face 14 and with a generally rectangular recess 31*b* opposite the recess 31*a* on the front face 14. The purpose of the grooved recesses 30*a* and 30*b* and the rectangular recesses 31*a* and 31*b* is to lighten and distribute the weight of the plastic body 12 to assure that the hanger unit 10 will float with its upper handle portion 25 extending out of the solution when a film chip 39 is held by the clip 23 on the bottom end thereof.

Figure 3:
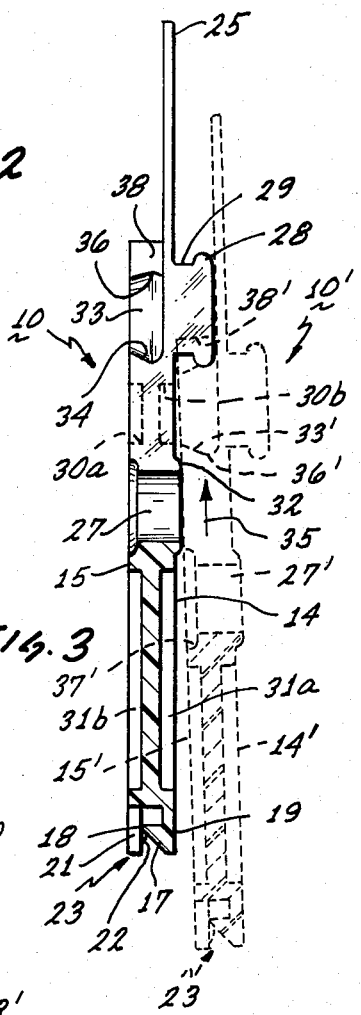
FIG. 3 is a vertical sectional view of a first hanger unit as taken on line 3—3 of FIG. 1 and illustrating by dashed lines how a second hanger unit can be positioned relative to the first hanger unit prior to the two hanger units being snapped together.

Reference will next be made to FIG. 3 which shows in solid lines a vertical sectional view of a first hanger unit 10 as taken along line 3—3 of FIG. 1. Shown in section by dotted lines is a second identical hanger unit 10′ bearing reference designations for the parts thereof which are primed to distinguish them from the corresponding parts of the front hanger unit 10.

As shown, the second hanger unit 10′ is positioned with its chamfered shoulders 38′ on the back face 15′ thereof respectively positioned beneath the sides of the circular projection 28 on the front face 14 of the first hanger unit 10. When so positioned, the plane of the second hanger unit 10′ lies at a slight angle with respect to the plane of the first hanger unit 10, as shown, because of the circular projecting rim 32 provided on the front face 14 of the latter. The second hanger unit 10′ is then pushed upwardly, as indicated by arrow 35, such that the sides of circular recess 33′ thereon respectively slip over the sides of the circular projection 28 such that the latter is seated in the enlarged diameter circular bottom 36′ of the circular recess 33′.

It should now be appreciated that the longitudinal slot 26 on body 12 of the first hanger unit 10 permits the upper side portions of the body 12 to bend inwardly toward each other. Likewise, the longitudinal slot 26′ on the body 12′ of the second hanger unit 10′ permits the upper side portions of the body 12′ to bend away from each other. Thus, the longitudinal slots on the bodies of the hanger units facilitate the fitting of the sides of circular projection 28 provided on the first hanger unit 10 within the sides of the circular recess 33′ provided on the second hanger unit 10′.

Figure 4:
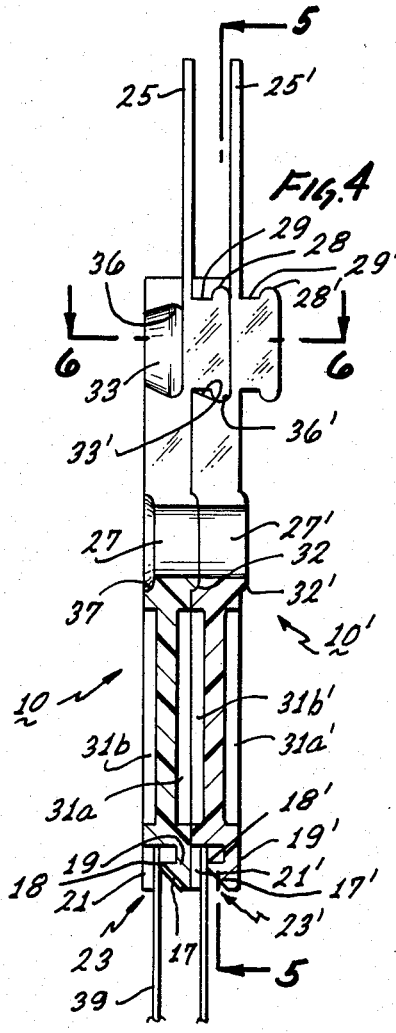
FIG. 4 is a vertical sectional view showing the pair of hanger units in FIG. 3 after they have been assembled together.

In any event, once so seated, the peripheral circular recess 37′ provided on the back face 15′ of the second hanger unit 10′ fits over the circular projecting rim 32 on the front face 14 of the first hanger unit 10 such that the back face 15′ of second hanger unit 10′ is now held in position flush against the front face 14 of the first hanger unit 10, as shown in FIG. 4.

Figure 5:
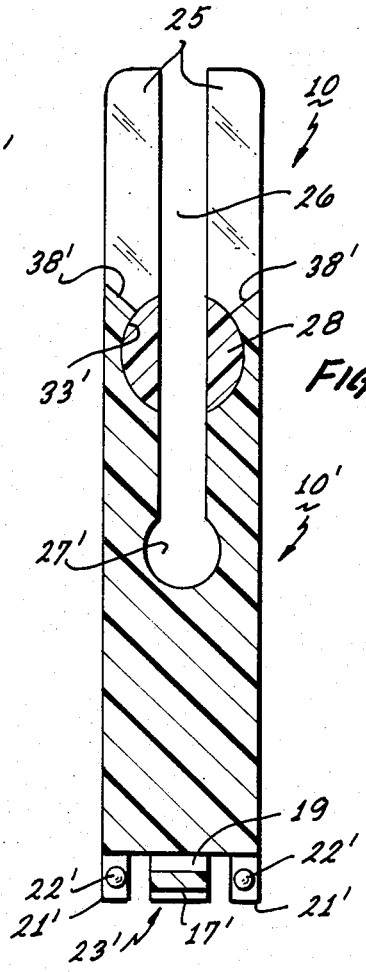
FIG. 5 is a vertical sectional view as taken along line 5—5 of FIG. 4.
Figure 6:
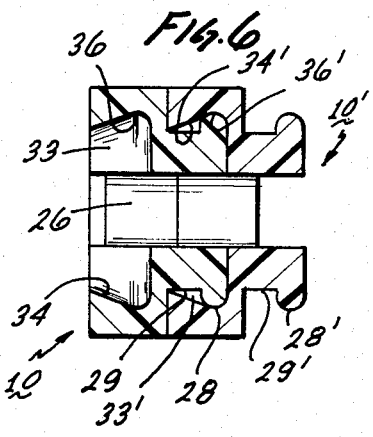
FIG. 6 is a cross sectional view as taken along line 6—6 of FIG. 4.

Reference will next be made to FIG. 5 which is a vertical sectional view taken on line 5—5 of FIG. 4 together with FIG. 6 which is a transverse cross sectional view as taken on line 6—6 of FIG. 4. Thus, these Figures show how the enlarged circular projection 28 provided on the front face 14 of the first hanger unit 10 is fitted to seat into the enlarged circular bottom 36′ of the circular recess 33′ provided on the face 15′ of the second hanger unit 10' so as to effectively provide a pivotal connection between the two hanger units 10 and 10'.

Figure 7:
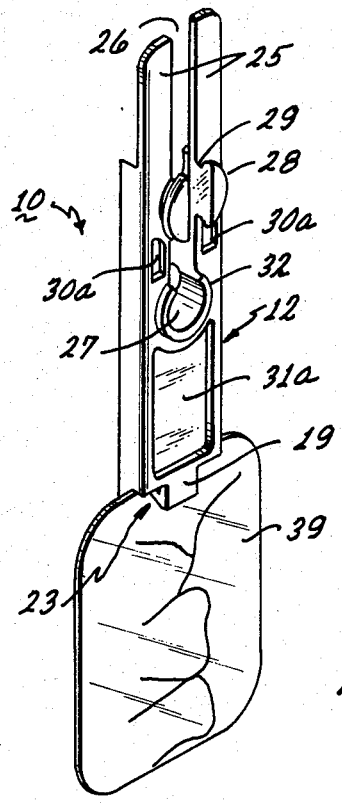
FIG. 7 is an elevational perspective view of a hanger unit with a dental film chip held on the bottom clip thereof.
Figure 8:
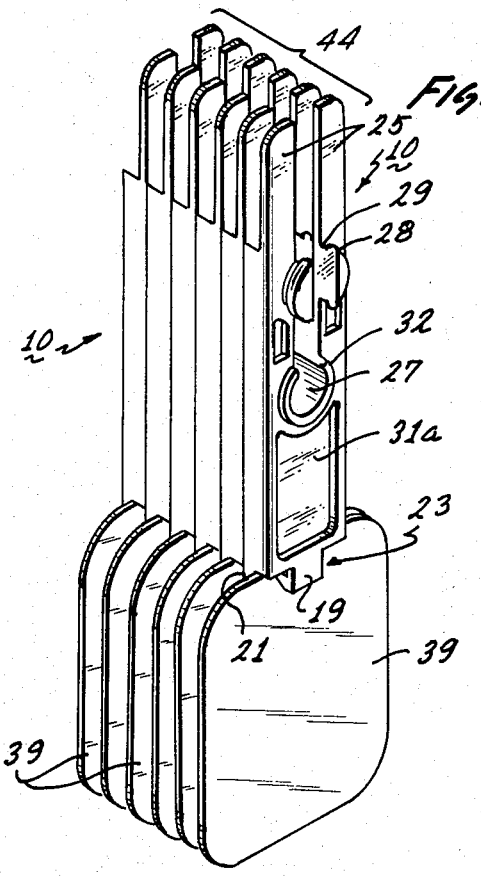
FIG. 8 is an elevational perspective view of an assembly of hanger units with dental film chips held on the bottom clips thereof.

Reference will next be made to FIG. 7 which illustrates a hanger unit 10 having a dental film chip 39 held by the clip 23 on the bottom end thereof and to FIG. 8 which illustrates how a plurality of hanger units 10 each having a film chip 39 clipped on the bottom end thereof can be held together, as above described, to form an assembly 44.

Figure 9:
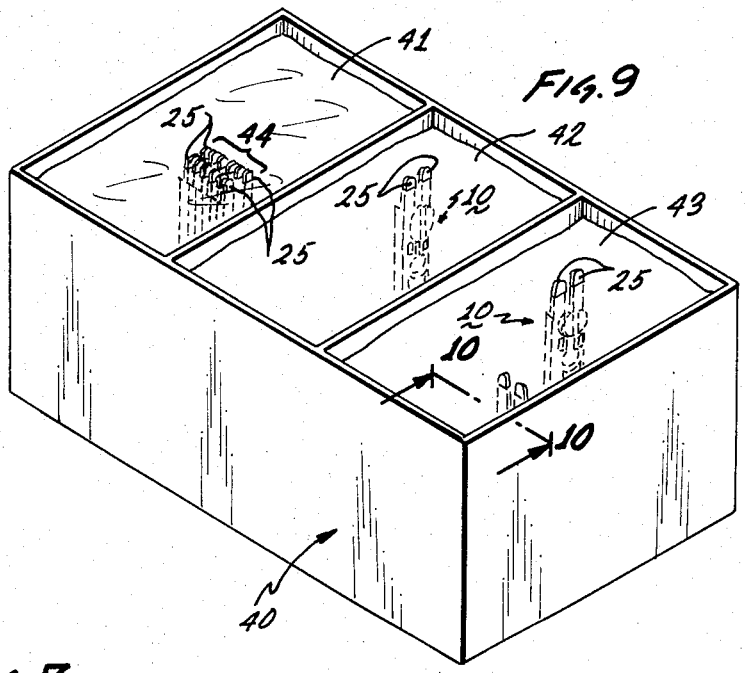
FIG. 9 illustrates a processing tank having three compartments of solutions in which hanger units with dental film chips on the bottom clips thereof are floating.
Figure 10:
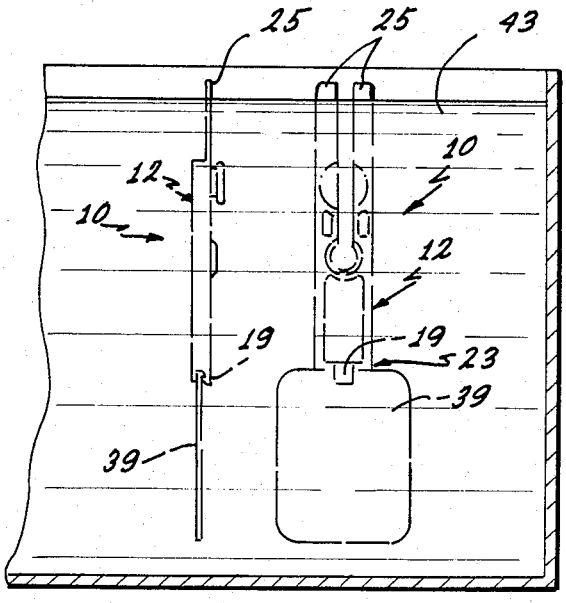
FIG. 10 is an elevational view of one of the compartments of the processing tank as taken on line 10—10 of FIG. 9 showing hanger units with dental film chips on the bottom clips thereof floating in the solution thereof.

FIG. 9 illustrates a processing tank 40 having either individual hanger units 10 or an assembly 44 of hanger units 10 floating in the solutions provided in the compartments 41, 42 and 43 thereof. As shown, the hanger units 10 float with their handle portions 25 extending out of the upper surface of the solutions thereof. As illustrated in FIG. 10, the film chips 39 are bouyantly supported at the same depth in the solution of a compartment and each compartment need be only deep enough to bouyantly accomodate the hanger unit 10 with the film chip 39 depending from the bottom clip 23 thereon. Color coding, for example, may be used to distinguish the hanger units 10 being used to hold the dental film chips for a particular patient.

Figure 11:
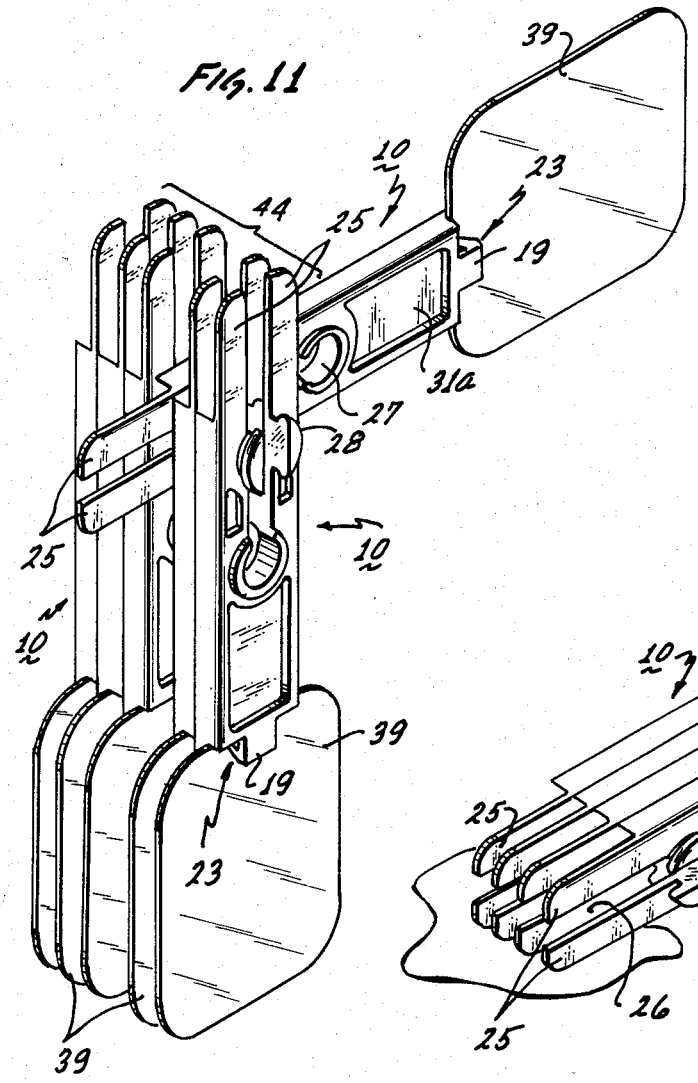
FIG. 11 is an elevational perspective view of an assembly of hanger units having dental film chips on the bottom clips thereof and showing one of the hanger units having been pivoted away from the others so that the dental film chip on the bottom clip thereof can be examined.

FIG. 11 shows how any selected one of the hanger units 10 in the assembly 44 can be pivoted on its circular projection 28 provided on the front face 14 thereof and its circular recess 33 provided on the back face 15 thereof away from the other hanger units 10 of the assembly 44 for the purpose of examining the dental film chip 39 held on the bottom thereof. It should be noted that the radially outwardly slanting internal wall 34 on the circular recess 33 of a hanger unit operates to retain the circular projection 28 on the next hanger unit 10 in the circular recess 33 as the central portions of the hanger units in the assembly are separated to free a hanger unit so that it can be pivoted outwardly from the others in the assembly.

Figure 12:
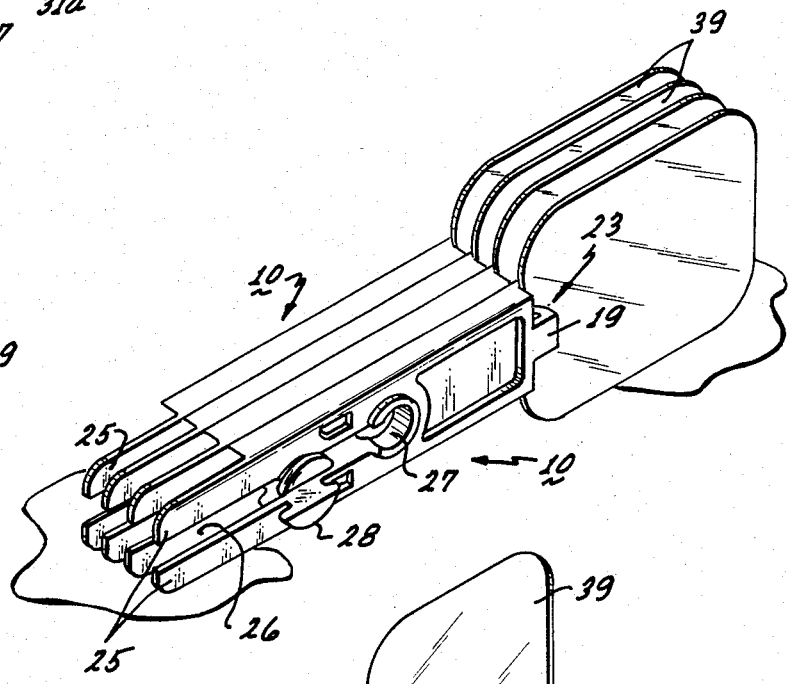
FIG. 12 is a perspective view showing how an assembly of hanger units having dental film chips on the bottom clips thereof can be mounted on its sides for drying the film chips.
Figure 13:
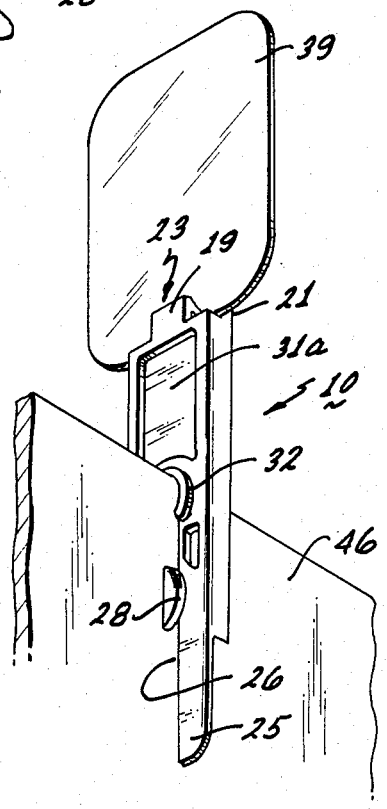
FIG. 13 is a perspective view showing how a hanger unit with a dental film chip held by the clip thereon can be mounted with the longitudinal slot on the handle end portion thereof fitted over the upper end of a vertical wall for drying the film chip.

FIG. 12 illustrates how an assembly of two or more hanger units 10 with film chips 39 held by the clips 23 thereof can be placed on its side to enable the film chips 39 to dry. FIG. 13 shows how a hanger unit 10 can be positioned with the longitudinal slot 16 in its body 12 fitted over the upper end of a wall 46 for the purpose of drying the film chip 39 held on the end thereof.

While the description has been concerned with a particular structural embodiment of the present invention, it is to be understood that many modifications and variations in the construction and arrangement thereof may be provided for without departing from the spirit and scope of the invention or sacrificing any of its advantages and the invention is, therefore, to be limited only as indicated by the scope of the appended claims.

What is claimed is:

1. A bouyant dental film chip hanger unit comprising:

an elongated rectangular plastic body having opposite flat faces and having a clip on the bottom end thereof and a handle portion on the upper end thereof;

a circular projection having a smaller diameter base on the face of said body below said handle portion;

a circular recess having an enlarged diameter bottom on the opposite face of said body on the same axis as said circular projection;

a circular hole provided through the central portion of said body;

a circular projecting rim on one face of said body about said circular hole;

a circular peripheral recess on the opposite face of said body about said circular hole; and a slot extending longitudinally through the middle of said body down from the top thereof through the handle portion, through the circular projection below said handle portion, and on down to the upper end of said circular hole.

2. A bouyant dental film chip hanger unit as defined in claim 1 wherein said body is molded with the upper end portion of said opposite face and including the upper wall of said circular recess removed leaving inwardly chamfered shoulders on the sides of said circular recess;

whereby the circular recess on said opposite face of one hanger unit can be positioned with its chamfered shoulders beneath the circular projection on one face of another hanger unit and upon being pushed up the sides of the circular recess will seat on the sides of said circular projection on said one face of said another hanger unit and said circular peripheral recess will seat over the circular projecting rim on said another hanger unit.

3. A bouyant dental film chip hanger unit as defined in claim 1 wherein said body is provided with recesses on the opposite faces thereof to lighten it so that when it is immersed in a solution with a dental film chip held on the clip on the bottom thereof, the body will float in an upright position with the upper portion thereof extending above the surface of the solution.

4. An assembly of bouyant dental film chip hanger units as defined in claim 1 wherein each hanger unit has its circular projection seated in the circular recess of the following hanger unit and has its circular projecting rim seated in the circular peripheral recess of said following hanger unit; and whereby any hanger unit in the assembly can have its circular projecting rim and its circular peripheral recess freed from the circular peripheral recess and circular projecting rim of the neighboring hanger units such that it can be pivoted out of the assembly so that the film chip held by the clip on the bottom end thereof can be examined.

5. A bouyant dental film chip hanger unit comprising:

an elongated molded plastic body having opposite generally flat faces and having a clip formed on the bottom end thereof;

said body having one of said faces provided with a circular projection thereon and the other of said faces provided with a circular recess thereon having the same axis as the circular projection;

said circular projection and said circular recess having compatible outer diameters and cross sections whereby the circular projection on the face of one hanger unit can be engaged in the circular recess on the opposite face of another hanger unit to hold said hanger units together in a face-to-face relationship;

wherein said clip includes;

a central tab depending from the bottom of one face of said body and having an angular stop on the interior surface thereof; and a pair of spaced side tabs depending from the bottom of the opposite face of said body and having protuberances on the interior surfaces thereof;

said projecting stop and said protuberances lying in substantially the same plane thereby providing for holding a film chip by its upper edge in a plane parallel to the plane of said body.

6. A bouyant dental film chip hanger unit comprising:

an elongated molded plastic body having opposite generally flat faces with a handle portion on the upper end thereof and a clip on the bottom end thereof for holding a film chip by its upper edge;

said body having one face thereof provided with a circular projection and the opposite face thereof provided with a circular recess having the same axis as the circular projection;

said handle portion having one face thereof flush with said one face of the body and the opposite face thereof set back from the plane of said opposite face of said body and extending downwardly into said circular recess by way of an opening providing shoulders on the upper sides of said circular recess, said shoulders being chamfered generally inwardly toward the axis of said circular recess;

said circular projection and said circular recess having compatible outer diameters and cross sections whereby the circular projection on the face of one hanger unit can be snapped through the opening provided by the inwardly chamfered shoulders on the upper sides of the circular recess on the opposite face of another hanger unit and seated therein to hold said hanger units together in a face-to-face relationship.

* * * * *